United States Patent [19]

Zoulek

[11] Patent Number: 4,827,707

[45] Date of Patent: May 9, 1989

[54] ZINC ALLOY BODY FOR BRAIDING MACHINE CARRIER

[76] Inventor: James R. Zoulek, 5350 Strohm #21, North Hollywood, Calif. 91601

[21] Appl. No.: 136,717

[22] Filed: Dec. 22, 1987

[51] Int. Cl.[4] ..... D04C 3/18; D04C 3/14

[52] U.S. Cl. ..... 87/57; 87/55; 87/56

[58] Field of Search ..... 87/21, 22, 55–57

[56] References Cited

U.S. PATENT DOCUMENTS

| | | | |
|---|---|---|---|
| 2,144,991 | 1/1939 | Mossberg | 87/56 X |
| 2,211,730 | 8/1940 | Olson | 87/55 |
| 2,718,810 | 9/1955 | Groh | 87/56 |
| 3,276,310 | 10/1966 | Radlauer | 87/22 |

*Primary Examiner*—John Petrakes

*Attorney, Agent, or Firm*—Hugh D. Jaeger

[57] ABSTRACT

A zinc alloy body for a braiding machine carrier. The zinc alloy body includes an upper modified oval tear drop member, a similarly shaped lower modified oval tear drop member and a vertical bar extending perpendicularly therebetween.

1 Claim, 5 Drawing Sheets

ZINC ALLOY BODY FOR BRAIDING MACHINE CARRIER

BACKGROUND OF THE INVENTION

1. Field of the Invention

The present invention pertains to carriers for braiding machines, and more particularly, pertains to a zinc alloy main body base for a carrier.

2. Description of the Prior Art

Prior art carriers have had a continual problem of the bodies wearing out. This has been very expensive, as it is time consuming and expensive to replace the main bodies. In the past, the main bodies have been made of iron or plastic and have not been suitable.

The problem has only been recently recognized with the solution that a zinc alloy provides the best material for a main body. The present invention of a zinc alloy main body overcomes the disadvantages of the prior art by providing a very effective long wearing main body member.

SUMMARY OF THE INVENTION

The general purpose of the present invention is to provide a zinc alloy main body for a carrier.

According to one embodiment of the present invention, there is provided a main body of zinc alloy, including an upper modified oval tear drop member, a similarly shaped lower oval tear drop member, and a vertical bar extending therebetween. The main body member is riveted or likewise secured onto the carrier.

One significant aspect and feature of the present invention is a zinc alloy main body member for a carrier which is long wearing and is a cost effective component.

Having thus described embodiments of the present invention, it is the principal object hereof to provide a zinc alloy main body member for a carrier.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
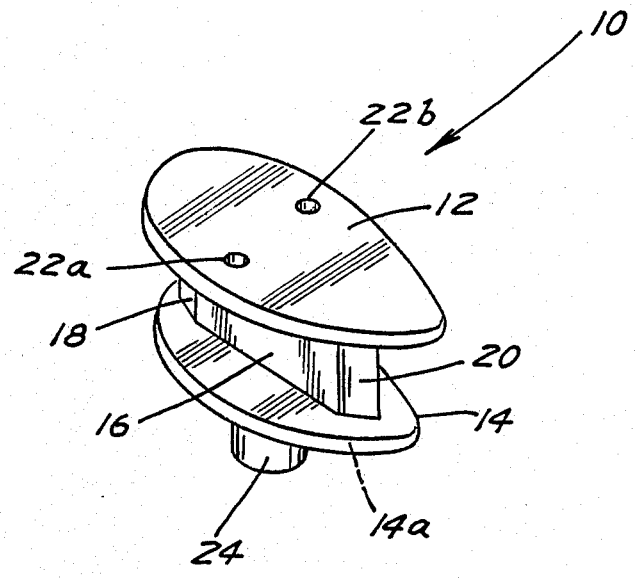
FIG. 1 illustrates a perspective view of a main body, the present invention, for a carrier.

FIG. 1 illustrates a perspective view of a main body 10, the present invention, for a braiding machine carrier. The main body is fashioned of a zinc alloy and replaces existing worn plastic main bodies on braiding machine carriers. The main body 10 includes an upper modified oval member 12 resembling a teardrop; a similar shaped lower modified oval member tear drop 14, being parallel and slightly less in dimension than the upper modified oval member 12; and a vertical bar or web member 16 extending perpendicularly between the upper and lower modified oval members 12 and 14, which includes vertically oriented tapered V ends 18 and 20 at opposing ends of the vertical bar or member 16. A plurality of rivet holes **22*a* and 22*b* are located in the upper modified oval member 12 to accommodate and accept rivets for attachment to the carrier as later described in detail. Additional or fewer holes can be utilized, or in the alternative, the members can be glued together or likewise secured together. A cylindrical post 24 is located on the bottom surface 14*a* of the lower modified oval member 14** for mounting and positioning in a braiding machine.

Figure 2:
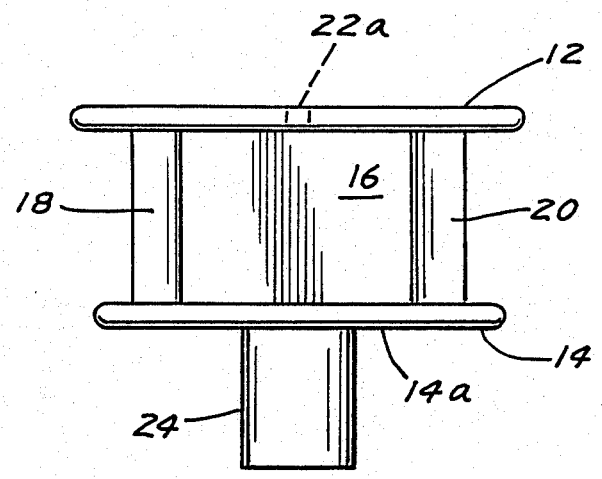
FIG. 2 illustrates a side view of the main body.

FIG. 2 illustrates a side view of the main body 10 where all numerals correspond to those elements previously described.

Figure 3:
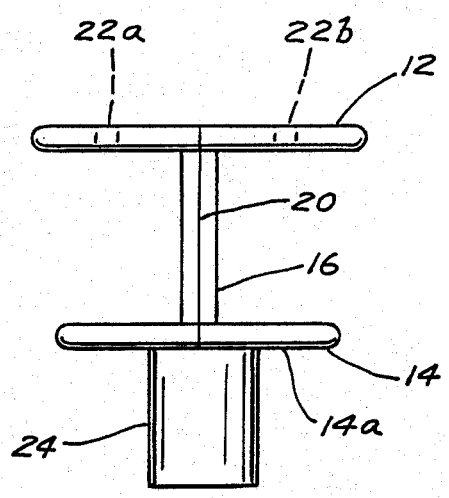
FIG. 3 illustrates an end view of the main body.

FIG. 3 illustrates an end view of the main body 10 where all numerals correspond to those elements previously described.

Figure 4:
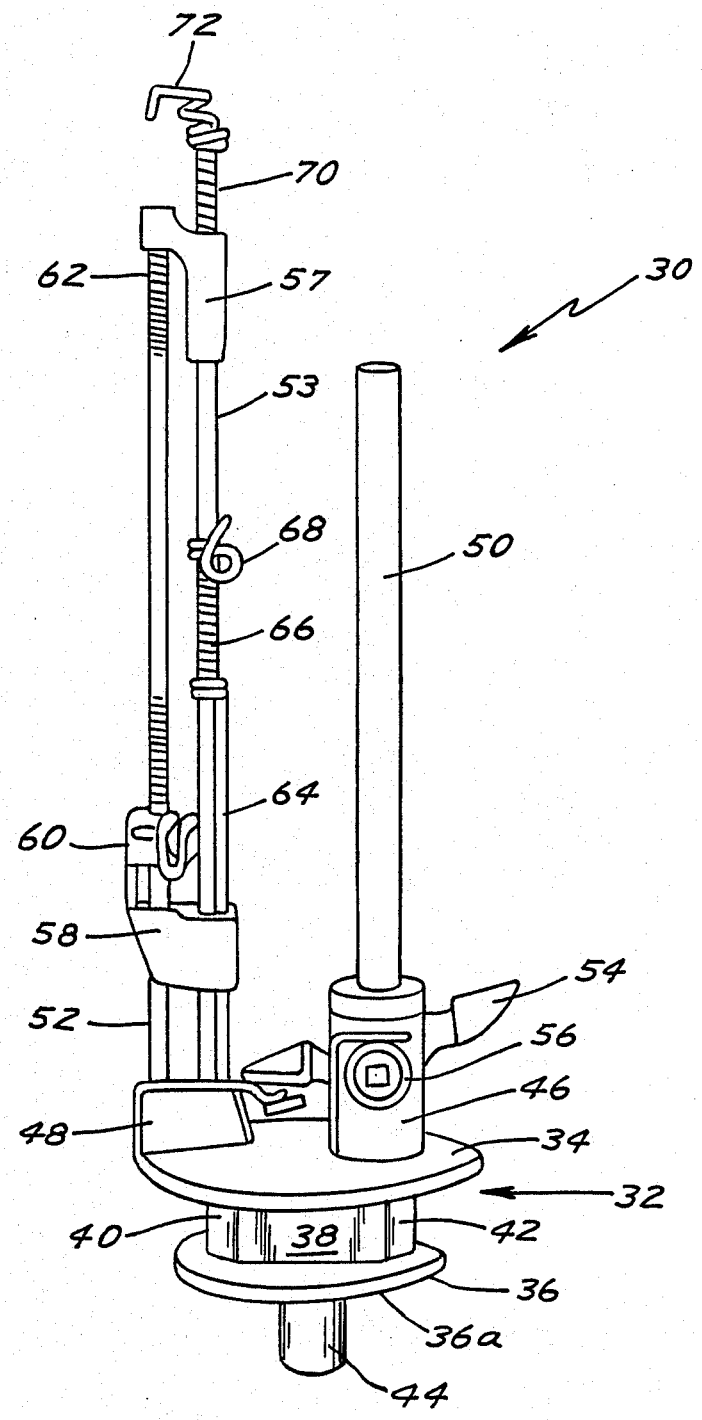
FIG. 4 illustrates a perspective view of a prior art carrier assembly.
Figure 5:
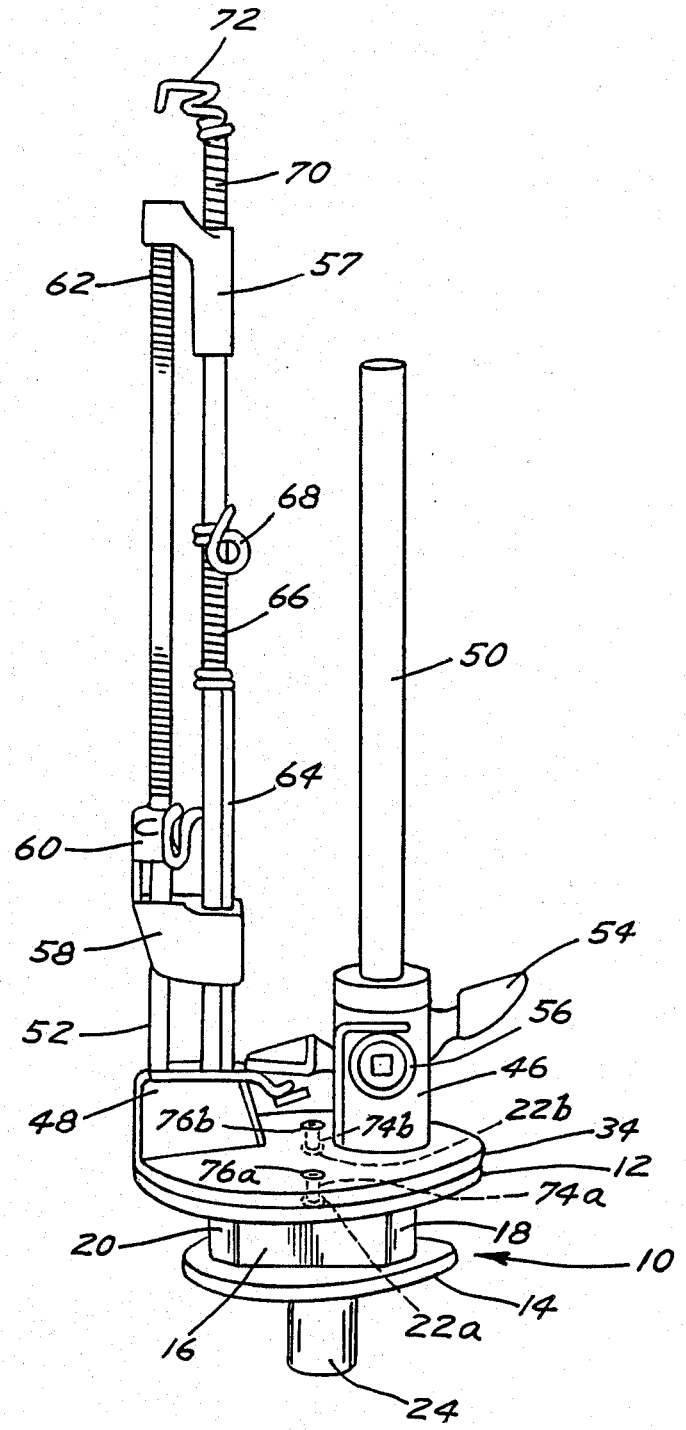
FIG. 5 illustrates a perspective view of a carrier assembly with a main body of the present invention secured thereto.

FIG. 4 illustrates a perspective view of a prior art carrier assembly 30 to which the main body 10 secures as described in FIG. 5. The carrier assembly 30 includes the original main body 32; an upper modified oval member 34; a lower modified oval member 36; a vertical bar or web member 38, including tapered ends 40 and 42 between the upper and lower modified oval members 34 and 36; and cylindrical post 44 located on the lower surface **36*a* of the lower modified oval member 36. The upper modified oval member 34 of the original main body also includes a bobbin post mount 46 and a tension rod mount 48. A bobbin post 50 positions in the bobbin post mount 46, and a tension rod 52 and a center rod 53 position in the tension rod mount 48. A bobbin pawl 54 secures to the bobbin post mount 46 with a snap ring 56. A connecting link 57 positions between the top portions of the tension rod 52 and the center rod 53. A stopper 58, a stopper hook 60 and a tension spring 62 locate on the tension rod 52. Additional components, including a float 64, a float spring 66, a center thread guide 68, a connecting link spring 70 and a top thread guide 72 position about the center rod 53**.

MODE OF OPERATION

FIG. 5 illustrates the mode of operation where all numerals correspond to those elements previously described. With reference to FIG. 4, the greater portion of the original plastic or iron main body 32 is cut or otherwise parted from the carrier assembly 30. The original upper modified oval member 34 is left intact while the original worn vertical bar or web member 38, the original lower modified oval member 36, and the original cylindrical post 44 are separated prior to installation of the present invention main body 10. Holes **74*a* and 74*b* are drilled in the original upper modified oval member 34 to align with rivet holes 22*a* and 22*b* of the upper modified oval member 12 of the present invention main body 10. The present invention body 10 is then secured by common or pop rivets 76*a* and 76*b* extending through rivet holes 22*a* and 22*b* of the present invention upper modified oval member 12 and holes 74*a* and 74*b* of the original upper modified oval member 34 of the original main body 32**.

Various modifications can be made to the present invention without departing from the apparent scope thereof.

I claim:

1. In combination, a zinc alloy main body and a braiding carrier comprising:

a. braiding carrier comprising an oval tear drop member supporting a stopper, tension spring, float spring, center rod, tension rod, bobbin pawl, center thread guide, top thread guide, stopper hook, float, connecting link, connecting link spring, snap ring, and bobbin post; and, b. a zinc alloy main body comprising upper modified oval tear drop member means secured to said oval tear drop member of said carrier, lower modified oval tear drop member means with a cylindrical lower post, and vertical bar member with tapered ends extending therebetween, whereby said zinc alloy main body member provides optimum wear characteristics.

* * * * *